US011904372B2

(12) United States Patent
Wakayama et al.

(10) Patent No.: US 11,904,372 B2
(45) Date of Patent: Feb. 20, 2024

(54) METHOD FOR FORMING SPOOL IN PIPE AND MANUFACTURING APPARATUS FOR FORMING SPOOL IN PIPE

(71) Applicant: FUTABA INDUSTRIAL CO., LTD., Aichi (JP)

(72) Inventors: Mikuto Wakayama, Aichi (JP); Daisuke Izumikawa, Aichi (JP); Atsuya Hirade, Aichi (JP)

(73) Assignee: FUTABA INDUSTRIAL CO., LTD., Aichi (JP)

( * ) Notice: Subject to any disclaimer, the term of this patent is extended or adjusted under 35 U.S.C. 154(b) by 0 days.

(21) Appl. No.: 17/942,596

(22) Filed: Sep. 12, 2022

(65) Prior Publication Data

US 2023/0099771 A1 Mar. 30, 2023

(30) Foreign Application Priority Data

Sep. 27, 2021 (JP) ..... 2021-157220

(51) Int. Cl.
*B21D 17/02* (2006.01)

(52) U.S. Cl.
CPC ..... *B21D 17/025* (2013.01)

(58) Field of Classification Search
CPC ..... B21D 17/02; B21D 17/025; B21D 19/08; B21D 15/04; B21D 15/06; B21D 41/02; B21D 41/025
See application file for complete search history.

(56) References Cited

U.S. PATENT DOCUMENTS 1,835,314 A * 12/1931 Lord ..... B21D 15/06 72/59
3,375,689 A * 4/1968 Millar ..... B21D 15/10 72/59
3,457,751 A * 7/1969 Lindeman ..... B21D 15/06 72/105
3,866,457 A 2/1975 Bagby

FOREIGN PATENT DOCUMENTS

GB 323058 A * 12/1929
GB 363574 A * 12/1937
JP H06285552 A 10/1994
JP H08112675 A 5/1996
JP 3229365 B2 11/2001

OTHER PUBLICATIONS

Machine Translation of JP H06-285552A (Year: 1994).*
English translation and the Notice of Reasons for Refusal dated Jul. 11, 2023, in corresponding Japanese Patent Application No. 2021-157220.

* cited by examiner

*Primary Examiner* — Debra M Sullivan
(74) *Attorney, Agent, or Firm* — David D. Brush; Westman, Champlin & Koehler, P.A.

(57) ABSTRACT

A side wall of a pipe is clamped by a first die and a second die to thereby clamp the pipe. The first die and the second die are made to approach each other while an end of the pipe is pressed toward the first die by the third die along a longitudinal direction of the pipe, to thereby form a spool between the first die and the second die. In a state where the spool is clamped by the first die and the second die, the third die is separated from the pipe along the longitudinal direction of the pipe so as to separate the second die and the third die from each other. Clamping of the pipe is released such that the first die and the second die separate from the side wall of the pipe, to thereby unclamp the pipe.

4 Claims, 5 Drawing Sheets

METHOD FOR FORMING SPOOL IN PIPE AND MANUFACTURING APPARATUS FOR FORMING SPOOL IN PIPE

CROSS-REFERENCE TO RELATED APPLICATIONS

This application claims the benefit of Japanese Patent Application No. 2021-157220 filed on Sep. 27, 2021 with the Japan Patent Office, the entire disclosure of which is incorporated herein by reference.

BACKGROUND

The present disclosure relates to a method for forming a spool in a pipe and a manufacturing apparatus for forming a spool in a pipe.

There is a known technique of bending a part of a side wall of a pipe so as to protrude from an outer circumferential surface to thereby form a spool extending around the outer circumferential surface. The spool is used to couple the pipe to another member.

Japanese Unexamined Patent Application Publication No. H8-112675 discloses a manufacturing method of a pipe with a spool using dies that include an upper die, a lower die, and a receiving die configured to slide toward a pipe so as to surround the pipe between the upper die and the lower die. In this manufacturing method using dies, a pipe is first set in the lower die, and then the pipe is clamped by the receiving die, and subsequently the upper die is lowered to press down an end of the pipe. As a result, the pipe bulges outward, and a spool is formed between the upper die and the receiving die.

SUMMARY

According to the aforementioned manufacturing method using dies, the upper die is pulled out of the pipe after forming the spool. At this moment, due to a friction that may be caused between the upper die and the pipe, a shear force to pull the pipe in a pullout direction of the upper die is likely to occur. Thus, there is a problem that the shear force is likely to cause cracks in an inside portion of a top of the spool.

In one aspect of the present disclosure, it is desirable to provide a technique to reduce occurrence of cracks in a spool formed in a pipe.

One aspect of the present disclosure is a method for forming a spool, which is a portion protruding outward of a pipe, in a part of a side wall of the pipe. The method comprises a clamping process, a forming process, a separating process, and an unclamping process. In the clamping process, the side wall of the pipe is clamped by a first die comprising at least two members, and also the side wall of the pipe is clamped by a second die comprising at least two members. In the forming process, the first die and the second die are made to approach each other, while an end of the pipe is pressed by a third die toward the first die along a longitudinal direction of the pipe, to thereby form the spool between the first die and the second die. In the separating process, the third die is separated from the pipe along the longitudinal direction of the pipe such that the second die and the third die separate from each other in a state where the spool is clamped by the first die and the second die. In the unclamping process, clamping of the pipe is released such that at least one of the at least two members of the first die and at least one of the at least two members of the second die separate from the side wall of the pipe.

With such configuration, when the third die is separated from the pipe along the longitudinal direction of the pipe in the separating process after forming the spool, a state is maintained in which the spool is clamped by the first die and the second die. Thus, even if a shear force to pull the pipe in a moving direction of the third die is caused due to friction that may be caused between the third die and the pipe, the spool is less likely to be affected by the shear force. In other words, even if a shear force is applied to the pipe in a direction of unfolding the spool in the separating process, movement of the spool is limited by the second die. Accordingly, occurrence of cracks in the spool formed in the pipe can be reduced.

In one aspect of the present disclosure, the first die and the second die may be coupled through a repulsive force generation device. In the forming process and the separating process, the second die may be pressed in directions to clamp the pipe. In the unclamping process, when the second die becomes no longer pressed in the directions to clamp the pipe, the first die and the second die may separate from each other by the repulsive force generation device. With such configuration, since the first die and the second die are integrally configured through the repulsive force generation device, it is possible to avoid excessive size increase of the manufacturing apparatus for forming a pipe provided with a spool, and to facilitate storage and maintenance of the manufacturing apparatus.

In one aspect of the present disclosure, the repulsive force generation device may be an elastic member. With such configuration, it is possible to easily increase or reduce the distance between the first die and the second die that are integrally formed by means of an elastic force of the elastic member.

One aspect of the present disclosure may further comprise a pre-forming process to form a preliminary configuration of the spool prior to the forming process. The pre-forming process may comprise a pipe expansion processing to expand the pipe and a pipe contraction processing to contract the pipe after the pipe expansion processing. With such configuration, since the preliminary configuration of the spool is formed in the pre-forming process, it is possible to stabilize the shape and height of the spool formed in the forming process. Also, formation of the preliminary configuration of the spool can reduce loads applied on the respective dies when forming the spool in the forming process. Further, formation of the preliminary configuration of the spool can reduce a springback amount after forming the spool. Moreover, since formation of the preliminary configuration of the spool is performed by pipe expansion processing and pipe contraction processing, reduction in plate thickness when forming the spool can be decreased, as compared with a case of forming the preliminary configuration of the spool, for example, by roll-forming or press-forming.

In one aspect of the present disclosure, the longitudinal direction of the pipe may be a direction along a horizontal direction. The first die may comprise: a first upper die configured to surround the pipe from above; and a first lower die configured to surround the pipe from below. The second die may comprise: a second upper die configured to surround the pipe from above; and a second lower die configured to surround the pipe from below. The third die may be configured to move in the direction along the horizontal direction. With such configuration, in a state where the pipe is arranged to extend in a substantially horizontal direction, the pipe is clamped from above and below by the first die and the second die, and then the third die is moved in the horizontal direction, to thereby form the spool. Thus, the pipe is less likely to fall over without clamping a large area of the pipe by the first die and the second die, as compared with a case where the pipe is arranged to extend in a substantially vertical direction and the third die is moved in a direction along the vertical direction. Accordingly, it is possible to limit size increase of the manufacturing apparatus when forming the spool in the pipe of long length.

One aspect of the present disclosure is a manufacturing apparatus for forming a spool, which is a portion protruding outward of a pipe, in a part of a side wall of the pipe. The manufacturing apparatus comprises: a first die, a second die, and a third die. The first die and the second die are configured to surround the pipe along a circumferential direction and arrangeable a specific distance apart from each other along a longitudinal direction of the pipe. The third die is configured to be arranged on an opposite side to the first die with respect to the second die when forming the spool, and comprises: a first pressing portion configured to press an end of the pipe on the opposite side toward the first die; and a second pressing portion configured to press the second die toward the first die. The manufacturing apparatus is configured such that the first die and the second die are arranged a specific distance apart from each other, and the end of the pipe on the opposite side and the second die are pressed by the third die, to thereby form the spool between the first die and the second die. The manufacturing apparatus is also configured such that the second die is movable, subsequent to formation of the spool, so as to separate from the side wall of the pipe independently of moving the third die in a direction of separating from the first die along the longitudinal direction of the pipe.

With such configuration, after forming the spool, the second die moves so as to separate from the side wall of the pipe independently of the third die. This enables the second die to be maintained in a fixed position even when the third die is moved. Thus, owing to the second die arranged between the spool and the third die, the spool is less likely to be affected by the shear force to pull the pipe that may occur due to the movement of the third die. Accordingly, it is possible to reduce occurrence of cracks in the spool formed in the pipe.

BRIEF DESCRIPTION OF THE DRAWINGS

One embodiment of the present disclosure will be described hereinafter by way of example with reference to the accompanying drawings, in which.

DETAILED DESCRIPTION OF EXEMPLARY EMBODIMENTS

1. Configuration of Pipe Provided with Spool

Figure 1:
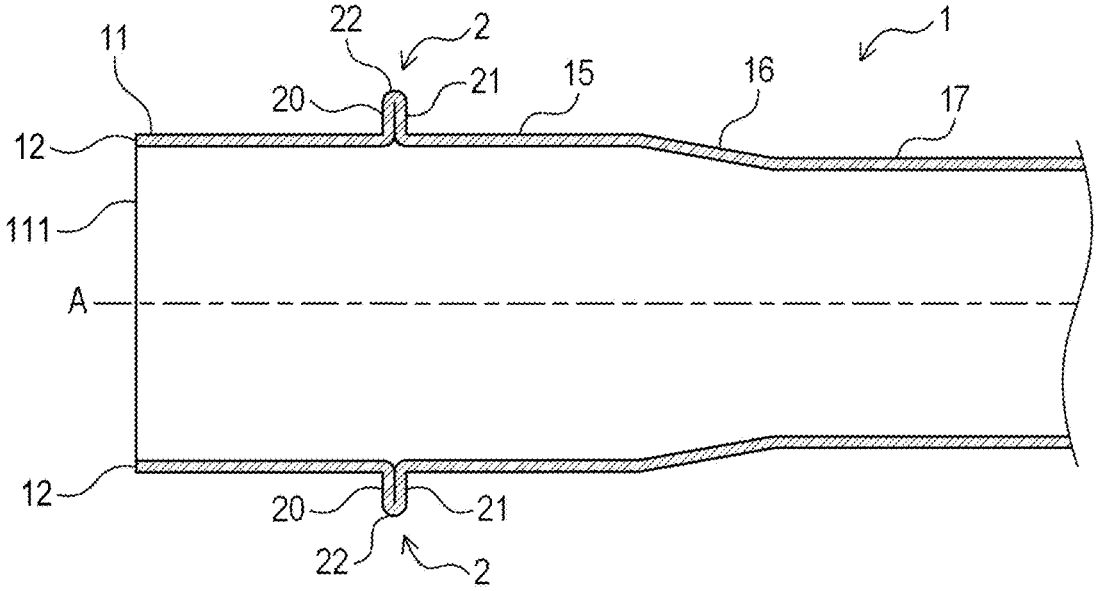
FIG. 1 is a schematic sectional view showing a pipe provided with a spool.

A pipe 1 shown in FIG. 1 is installed, for example, in a vehicle and used as a flow path of fuel for the vehicle. The pipe 1 is formed in a cylindrical shape. The pipe 1 is a substantially linear pipe elongated along a central axis A. In FIG. 1, for illustrative purposes, a first opening at a first end of the pipe is not shown, and a second opening 111, which is an opening at a second end 11 opposite to the first end, is shown. The pipe 1 is a metal pipe formed of a metal, such as iron, stainless steel, or high tensile strength steel. The pipe 1 is configured with a side wall 12, which is a wall-shaped portion separating inside and outside of the pipe 1. An outer surface of the side wall 12 forms an outer circumferential surface 13 of the pipe 1, and an inner surface of the side wall 12 forms an inner circumferential surface 14 of the pipe 1. The pipe 1 comprises an expanded pipe portion 15, a tapered portion 16, a main body portion 17, and a spool 2.

The expanded pipe portion 15 is a part of the pipe 1 in which pipe expansion processing to increase its diameter is performed. The expanded pipe portion 15 is provided at the second end 11 of the pipe 1.

The main body portion 17 is a part of the pipe 1 in which pipe expansion processing is not performed.

The tapered portion 16 is a part connecting the main body portion 17 and the expanded pipe portion 15, and has a tapered shape with a gradually increasing diameter from a first end side toward a second end 11 side.

The spool 2 is provided in a vicinity of the second opening 111 of the pipe 1. In the present embodiment, the spool 2 is formed in the expanded pipe portion 15. However, the spool 2 may be formed in another part of the pipe 1, other than the expanded pipe portion 15. The spool 2 is a portion that is provided in a part of the side wall 12 of the pipe 1 and protrudes outward of the pipe 1. The spool 2 is formed by protruding a part of the side wall 12 of the pipe 1 outward of the pipe 1. The spool 2 is used to connect the pipe 1 to other member, such as a connection port of a quick connector to be installed in the vehicle. The spool 2 comprises a first portion 20, a second portion 21, and a top region 22. The first portion 20 and the second portion 21 each protrude straight from the side wall 12 outward of the pipe, and the first portion 20, the second portion 21 are located in this order from the second end 11 side along the central axis A. The first portion 20 and the second portion 21 abut each other in a substantially parallel state. The top region 22 is a distal end of the spool 2 connecting respective outer ends of the first portion 20 and the second portion 21 in a curved manner.

Figure 2:
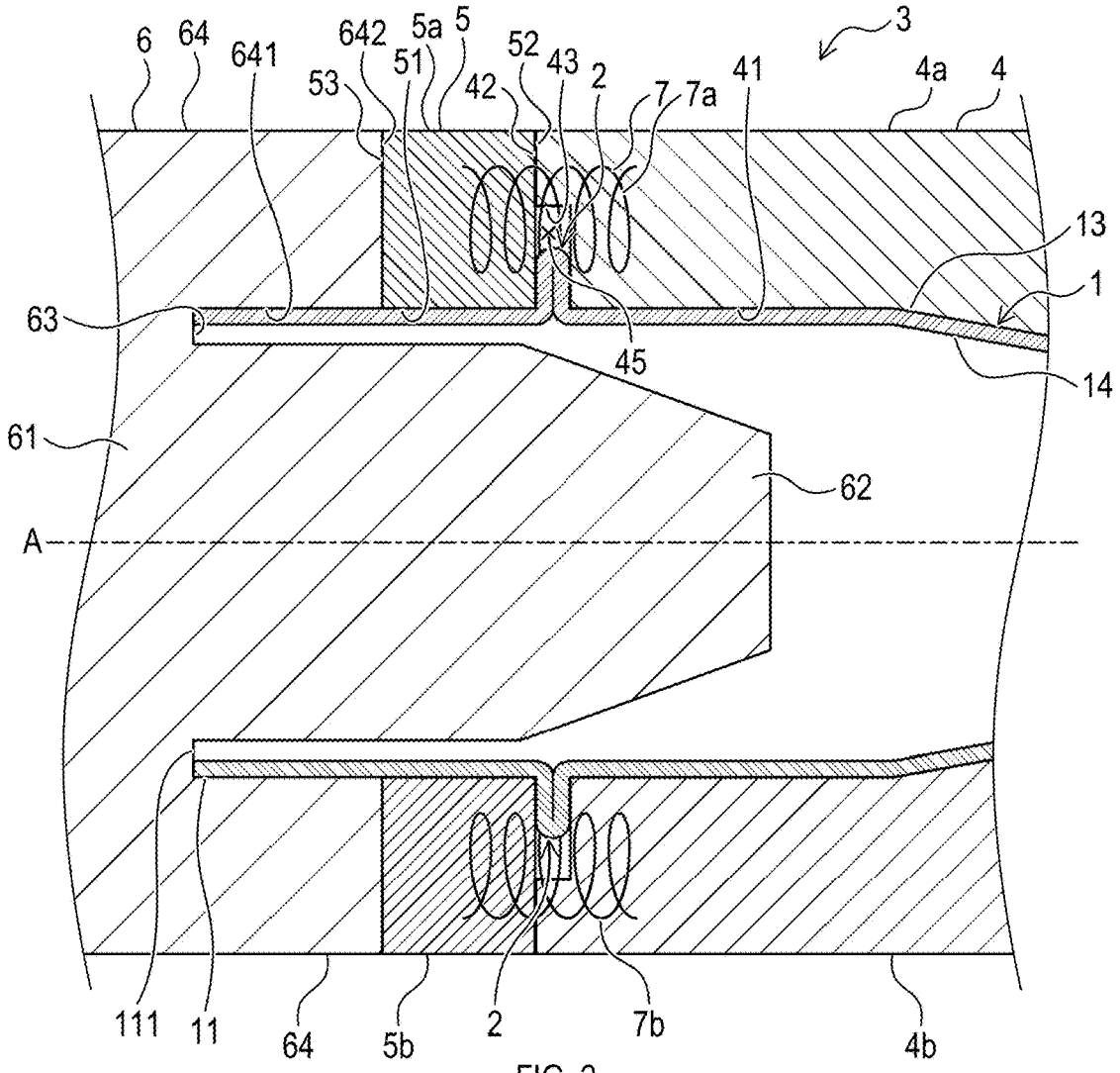
FIG. 2 is a schematic sectional view showing a first die, a second die, a third die, and the pipe provided with the spool when forming the spool.

2. Configuration of Manufacturing Apparatus for Forming Pipe Provided with Spool Next, a description will be given of a manufacturing apparatus 3 for forming the pipe 1 provided with the spool 2 with reference to FIG. 2. FIG. 2 shows a state when forming the spool 2 by the manufacturing apparatus 3. As shown in FIG. 2, the manufacturing apparatus 3 comprises a first die 4, a second die 5, a third die 6, and a repulsive force generation device 7.

The first die 4 and the second die 5 are arranged so as to surround the pipe 1 along a circumferential direction. The third die 6 is arranged on an opposite side of the first die 4 with respect to the second die 5 when forming the spool 2. Specifically, the third die 6 is arranged so as to cover the second opening 111 of the pipe 1.

The first die 4 and the second die 5 are coupled to each other through the repulsive force generation device 7. The repulsive force generation device 7 has a repulsive force in a direction of separating the first die 4 and the second die 5 from each other. Thus, in a later-described initial position of the manufacturing apparatus 3 shown in FIG. 3A, the first die 4 and the second die 5 are located a specific distance apart from each other in directions along the central axis A of the pipe 1, specifically along longitudinal directions of the pipe 1.

In the present embodiment, an elastic member, such as a spring, is used for the repulsive force generation device 7. The repulsive force generation device 7 of the present embodiment comprises a first spring 7*a* and a second spring 7*b*. The first spring 7*a* comprises a first end that is connected to a second die 5-side end of a later-described first upper die 4*a* of the first die 4, and a second end that is opposite to the first end and is connected to a first die 4-side end of a later-described second upper die 5*a* of the second die 5. The second spring 7*b* comprises a first end that is connected to a second die 5-side end of a later-described first lower die 4*b* of the first die 4, and a second end that is opposite to the first end and is connected to a first die 4-side end of a later-described second lower die 5*b* of the second die 5.

The first die 4 comprises the first upper die 4*a* configured to surround the pipe 1 from above and the first lower die 4*b* configured to surround the pipe 1 from below. The first upper die 4*a* comprises a first inner circumferential surface 41, a first abutment surface 42, and a cutout 43. Since the first lower die 4*b* has the same configuration as the first upper die 4*a*, the first lower die 4*b* will not be further described here.

The first inner circumferential surface 41 is a surface configured to abut the outer circumferential surface 13 of the pipe 1 when forming the spool 2. The first inner circumferential surface 41 has a curved shape so as to surround the pipe 1 that is cylindrically shaped. The first inner circumferential surface 41 covers an area of the outer circumferential surface 13 of the pipe 1 on a first end side of the pipe 1 with respect to a forming position of the spool 2.

The first abutment surface 42 is a surface that is provided at the second die 5-side end of the first upper die 4*a* and is configured to abut a later-described second abutment surface 52 of the second die 5 when forming the spool 2.

The cutout 43 is provided in a surface connecting the first abutment surface 42 and the first inner circumferential surface 41 at the second die 5-side end of the first upper die 4*a*. The cutout 43 forms a groove 45 positioned between the first die 4 and the second die 5 when forming the spool 2. A part of the side wall 12 of the pipe 1 enters into the groove 45, and thereby the spool 2 is formed.

The second die 5 comprises the second upper die 5*a* configured to surround the pipe 1 from above and the second lower die 5*b* configured to surround the pipe 1 from below. The second upper die 5*a* comprises a second inner circumferential surface 51, a second abutment surface 52, and a second pressing surface 53. Since the second lower die 5*b* has the same configuration as the second upper die 5*a*, the second lower die 5*b* will not be further described here.

The second inner circumferential surface 51 is a surface configured to abut the outer circumferential surface 13 of the pipe 1 when forming the spool 2. The second inner circumferential surface 51 has a curved shape so as to surround the pipe 1 that is cylindrically shaped. The second inner circumferential surface 51 covers an area of the outer circumferential surface 13 of the pipe 1 on the second end 11 side of the pipe 1 with respect to the forming position of the spool 2.

The second abutment surface 52 is a surface that is provided at the first die 4-side end of the second upper die 5*a* and is configured to abut the first abutment surface 42 of the first die 4 when forming the spool 2.

The second pressing surface 53 is a surface that is provided at a third die 6-side end and is configured to abut a later-described third abutment surface 642 of a second pressing portion 64 of the third die 6 when forming the spool 2, thereby to be pressed by the second pressing portion 64.

The third die 6 comprises a base 61, an insertion portion 62, a first pressing portion 63, and the second pressing portion 64.

The insertion portion 62 and the second pressing portion 64 are provided to protrude from the base 61.

The insertion portion 62 is a substantially columnar portion protruding from a substantial center of the base 61. When forming the spool 2, the insertion portion 62 is inserted into the pipe 1 from the second opening 111 and extends along the central axis A of the pipe 1. In the present embodiment, there is a clearance between the insertion portion 62 inserted into the pipe 1 and the side wall 12 of the pipe 1 when forming the spool 2. However, there may be no clearance between the insertion portion 62 and the side wall 12 of the pipe 1. In the present embodiment, an end portion of the insertion portion 62 has a tapered shape with a gradually decreasing diameter toward an end in order to facilitate insertion through the second opening 111 of the pipe 1. However, the end portion of the insertion portion 62 may be not tapered.

The second pressing portion 64 is an annular portion protruding from the base 61 on an outer side relative to the insertion portion 62. The second pressing portion 64 is provided to surround the insertion portion 62 along the circumferential direction with a clearance relative to the insertion portion 62. When forming the spool 2, the second pressing portion 64 is arranged to extend along the central axis A of the pipe 1. In the clearance between the second pressing portion 64 and the insertion portion 62, the side wall 12 of the pipe 1 is arranged. The second pressing portion 64 comprises a third inner circumferential surface 641 and the third abutment surface 642.

The third inner circumferential surface 641 is a surface configured to abut the outer circumferential surface 13 of the pipe 1 when forming the spool 2. The third inner circumferential surface 641 has a curved shape so as to surround the pipe 1 that is cylindrically shaped. The third inner circumferential surface 641 covers an area of the outer circumferential surface 13 of the pipe 1 on the second end 11 side of the pipe 1 with respect to the area covered by the second inner circumferential surface 51 of the second die 5.

The third abutment surface 642 is a surface provided at a second die 5-side end of the second pressing portion 64 and configured to abut the second pressing surface 53 of the second die 5 when forming the spool 2.

The first pressing portion 63 is located at a depth of the clearance between the insertion portion 62 and the second pressing portion 64 in the base 61. When forming the spool 2, the second end 11 of the side wall 12 of the pipe 1 arranged between the second pressing portion 64 and the insertion portion 62 is pressed by the first pressing portion 63. In other words, when forming the spool 2, a rim of the pipe 1 surrounding the second opening 111 is pressed by the first pressing portion 63.

3. Manufacturing Method for Forming Pipe Provided with Spool

Next, a description will be given of a manufacturing method for forming the pipe 1 provided with the spool 2. The manufacturing processes for forming the pipe 1 provided with the spool 2 comprise an arrangement process, a clamping process, a forming process, a pullout process, and an unclamping process.

[Arrangement Process]

Figures 3A, 3B, 3C:
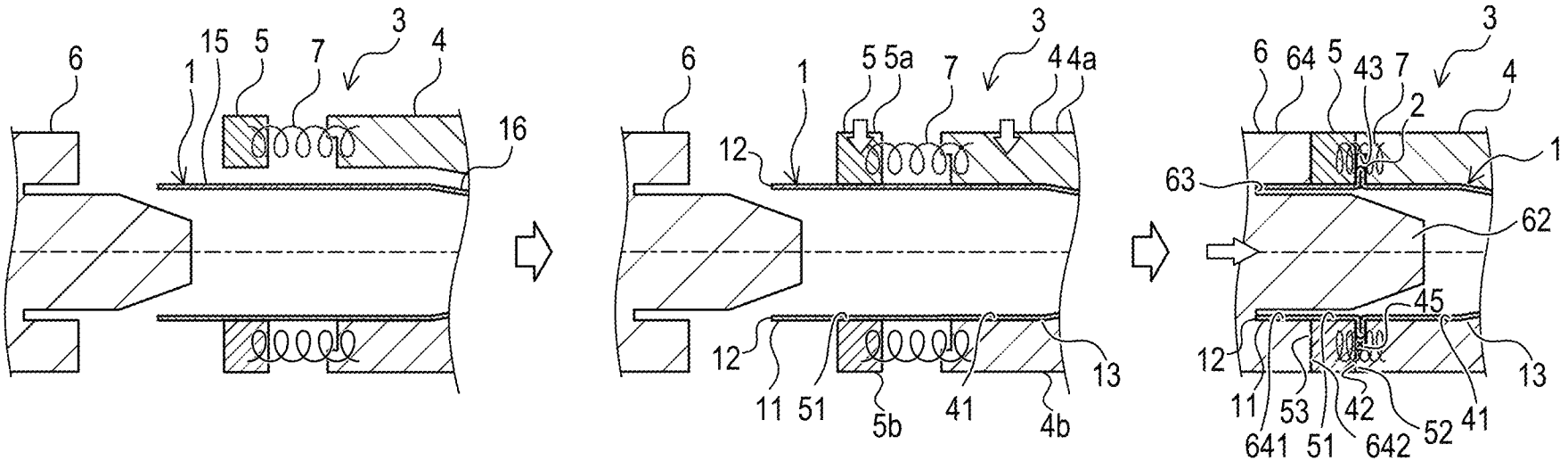
FIG. 3A is a schematic sectional view showing positions in an initial state of the first die, the second die, and the third die surrounding a pipe in an arrangement process.
FIG. 3B is a schematic sectional view showing a clamped state of the pipe in a clamping process.
FIG. 3C is a schematic sectional view showing a state of forming the spool in a forming process.

First, the pipe 1 is arranged to extend along a horizontal direction in a state where the expanded pipe portion 15, the tapered portion 16, and the main body portion 17 (not shown) are formed, but the spool 2 is not yet formed. Then, the first die 4, the second die 5, and the third die 6 are arranged so as to surround the pipe 1, as shown in FIG. 3A. A state where the first die 4, the second die 5, and the third die 6 are arranged in such manner is defined as an initial position of the manufacturing apparatus 3. In the initial position of the manufacturing apparatus 3, the first lower die 4*b* of the first die 4 and the second lower die 5*b* of the second die 5 abut the pipe 1 without pressing force applied thereto.

[Clamping Process]

Subsequently, as shown in FIG. 3B, the side wall 12 of the pipe 1 is clamped by the first upper die 4*a* and the first lower die 4*b* of the first die 4 from above and below. In this state, the respective first inner circumferential surface 41 of the first upper die 4*a* and the first lower die 4*b* cover an area of the outer circumferential surface 13 of the pipe 1 on the first end side of the pipe 1 with respect to the forming position at which the spool 2 is to be formed. Also, the side wall 12 of the pipe 1 is clamped by the second upper die 5*a* and the second lower die 5*b* of the second die 5 from above and below. In this state, the respective second inner circumferential surfaces 51 of the second upper die 5*a* and the second lower die 5*b* cover an area of the outer circumferential surface 13 of the pipe 1 on the second end 11 side of the pipe 1 with respect to the forming position at which the spool 2 is to be formed. In the clamping process, there is a specific distance between the first upper die 4*a* and the second upper die 5*a*, and between the first lower die 4*b* and the second lower die 5*b*, by means of the repulsive force generation device 7. The first die 4 and the second die 5 may clamp the pipe 1 simultaneously. Alternatively, the first die 4 and the second die 5 may clamp the pipe 1 not simultaneously but sequentially.

By the clamping process, the pipe 1 is pressed in pressing directions of the pipe 1 by the first upper die 4*a* and the first lower die 4*b* of the first die 4, and the second upper die 5*a* and the second lower die 5*b* of the second die 5.

[Forming Process]

Subsequently, as shown in FIG. 2 and FIG. 3C, the first die 4 and the second die 5 are made to approach each other, while pressing the second end 11 of the pipe 1 by the third die 6 toward the first die 4 along the central axis A of the pipe 1, and to thereby form the spool 2 between the first die 4 and the second die 5.

Specifically, first, a portion of the pipe 1 including the second end 11 is inserted between the insertion portion 62 and the second pressing portion 64 of the third die 6. In this case, the third inner circumferential surface 641 of the second pressing portion 64 abuts the outer circumferential surface 13 of the side wall 12 of the pipe 1, and there is a clearance between the insertion portion 62 inserted into the pipe 1 and the side wall 12 of the pipe 1.

Then, the third die 6 is moved in the horizontal direction in a state where the third abutment surface 642 of the third die 6 and the second pressing surface 53 of the second die 5 abut each other, while pressing the second end 11 of the pipe 1 arranged between the second pressing portion 64 and the insertion portion 62 by the first pressing portion 63 of the third die 6. In this case, the second die 5 is moved in the horizontal direction together with the third die 6. Pressing of the second end 11 of the pipe 1 by the first pressing portion 63 continues until the second abutment surface 52 of the second die 5 is brought into abutment with the first abutment surface 42 of the first die 4.

Contraction of the two springs of the repulsive force generation device 7 makes the second die 5 closer to the first die 4, and the second abutment surface 52 of the second die 5 is brought into abutment with the first abutment surface 42 of the first die 4. Then, the groove 45 is formed between the first die 4 and the second die 5 by the cutout 43 in the first die 4. In this state, an area of the outer circumferential surface 13 of the pipe 1 other than the forming position of the spool 2 is covered with the first inner circumferential surface 41 of the first die 4, the second inner circumferential surface 51 of the second die 5, and the third inner circumferential surface 641 of the second pressing portion 64 of the third die 6. Thus, a portion of the side wall 12 of the pipe 1 adjacent to the groove 45 enters into the groove 45 to thereby protrude, and a resulting protrusion forms the spool 2.

[Pullout Process]

Figures 4A, 4B, 4C, 4D:
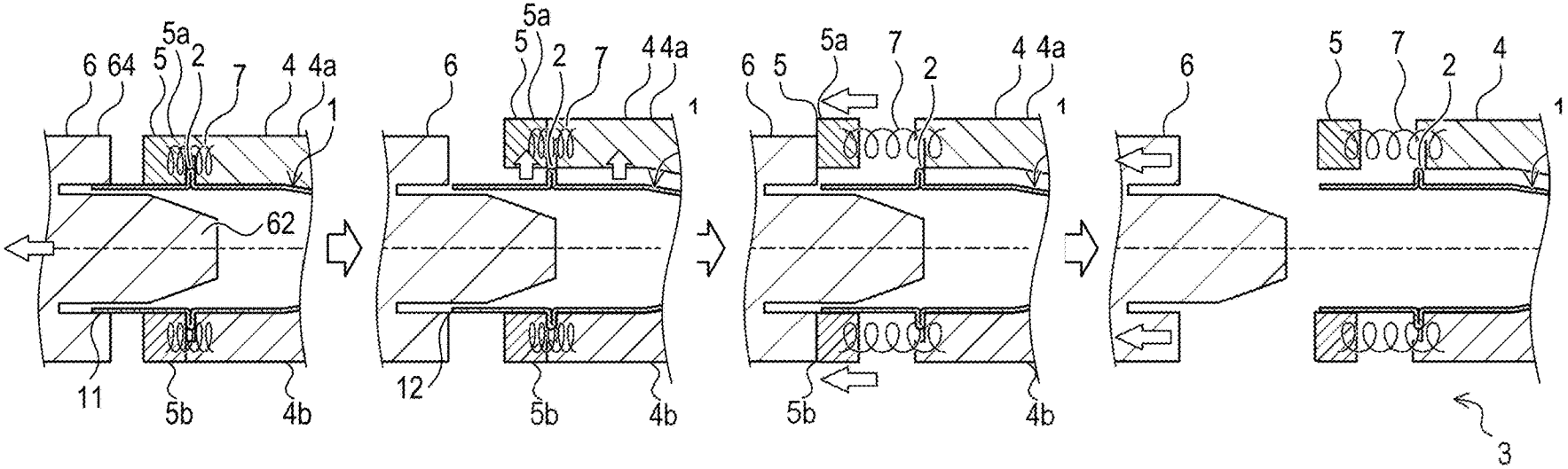
FIG. 4A is a schematic sectional view showing a state of pulling out the third die in a pullout process.
FIG. 4B is a schematic sectional view showing a state of releasing clamping of the pipe in an unclamping process.
FIG. 4C is a schematic sectional view showing a movement of the second die after releasing clamping of the pipe in the unclamping process.
FIG. 4D is a schematic sectional view showing the first die, the second die, and the third die that have returned to the initial state after forming the spool.

Subsequently, as shown in FIG. 4A, the third die 6 is made to separate from the pipe 1 along the central axis A of the pipe 1 so as to separate the third die 6 from the second die 5 in a state where the spool 2 is clamped by the first die 4 and the second die 5.

Specifically, the third die 6 is moved in the horizontal direction along the central axis A of the pipe 1 so as to separate from the first die 4, such that the second end 11 of the pipe 1 is pulled out from between the second pressing portion 64 and the insertion portion 62 of the third die 6, and the insertion portion 62 is pulled out of the pipe 1. In this process, the first upper die 4*a* and the first lower die 4*b* of the first die 4, and the second upper die 5*a* and the second lower die 5*b* of the second die 5 are pressed in directions to clamp the pipe 1, a state is maintained in which the spool 2 is clamped by the first die 4 and the second die 5.

[Unclamping Process]

Subsequently, as shown in FIG. 4B, independently of moving the third die 6 in a direction of separating from the first die 4, the first die 4 and the second die 5 are moved to separate from the side wall 12 of the pipe 1, to thereby release clamping of the pipe 1 (i.e., unclamp the pipe 1). In the present embodiment, the first upper die 4*a* of the first die 4 and the second upper die 5*a* of the second die 5 are moved to separate from the side wall 12 of the pipe 1, and thereby the pipe 1 is unclamped. Alternatively, the first lower die 4*b* of the first die 4 and the second lower die 5*b* of the second die 5 may be moved to separate from the side wall 12 of the pipe 1. Further alternatively, both of the first upper die 4*a* and the first lower die 4*b* of the first die 4, and both of the second upper die 5*a* and the second lower die 5*b* of the second die 5 may be moved to separate from the side wall 12 of the pipe 1.

Specifically, the first upper die 4*a* of the first die 4 and the second upper die 5*a* of the second die 5 are moved in an extending direction of the spool 2, specifically a direction substantially perpendicular to the side wall 12 of the pipe 1. In other words, the first upper die 4*a* of the first die 4 and the second upper die 5*a* of the second die 5 move in a vertical direction, while the third die 6 moves in the horizontal direction. The pipe 1 may be unclamped by the first die 4 and the second die 5 simultaneously. Alternatively, the pipe 1 may be unclamped not simultaneously but sequentially by the first die 4 and the second die 5.

As a result of the unclamping process, the first upper die 4*a* and the first lower die 4*b* of the first die 4, and the second upper die 5*a* and the second lower die 5*b* of the second die 5 are no longer pressed in the directions to clamp the pipe 1. Accordingly, as shown in FIG. 4C, due to extension of the two contracted springs of the repulsive force generation device 7, the second upper die 5*a* moves in a direction of separating from the first upper die 4*a*, and the second lower die 5*b* moves in a direction of separating from the first lower die 4*b*, and thus the first die 4 and the second die 5 are positioned a specific distance apart from each other.

Thereafter, as shown in FIG. 4D, the first die 4, the second die 5, and the third die 6 are arranged to return to the initial position of the manufacturing apparatus 3, and then the manufacturing method for forming the pipe 1 provided with the spool 2 is finished.

The manufacturing processes for forming the pipe 1 provided with the spool 2 may include a pre-forming process of forming a preliminary configuration of the spool 2. The pre-forming process may be executed before the above-described forming process, for example, between the clamping process and the forming process. Alternatively, the above-described processes from the arrangement process to the unclamping process may be executed using the pipe 1 after the pre-forming process is executed.

[Pre-forming Process]

<Pipe Expansion Processing>

Figures 5A, 5B, 5C:
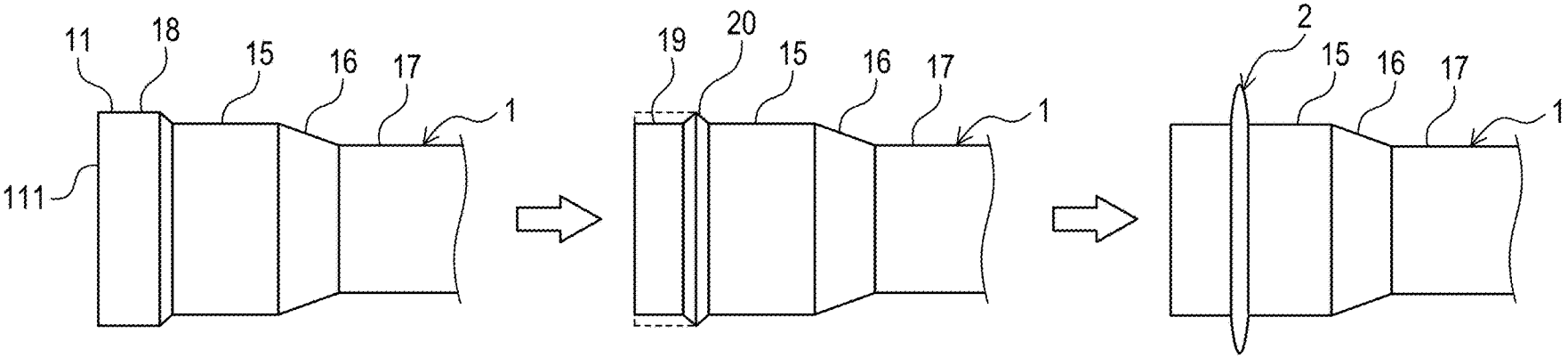
FIG. 5A is a schematic side view showing a state of a pipe after pipe expansion processing in a pre-forming process.
FIG. 5B is a schematic side view showing a state of the pipe including a preliminary configuration of a spool formed after pipe contraction processing in the pre-forming process.
FIG. 5C is a schematic side view showing a state of the pipe with a spool formed based on the preliminary configuration of the spool formed in the pipe in the pre-forming process.

First, as shown in FIG. 5A, a preliminary expanded pipe portion 18 having a diameter much greater than that of the expanded pipe portion 15 is formed on the second end 11 side of the pipe 1 in which the expanded pipe portion 15, the tapered portion 16, and the main body portion 17 are formed and the spool 2 is not yet formed.

<Pipe Contraction Processing>

Next, as shown in FIG. 5B, a contracted pipe portion 19 is formed by contracting the preliminary expanded pipe portion 18 on the second end 11 side of the pipe 1, to thereby form a preliminary spool 20 as a preliminary configuration of the spool 2 between the contracted pipe portion 19 and the expanded pipe portion 15.

Subsequently, the spool 2 is formed based on the preliminary spool 20 in accordance with the above-described forming process, as shown in FIG. 5C.

4. Effects

According to the embodiment detailed above, the following effects can be obtained.

Figure 6:
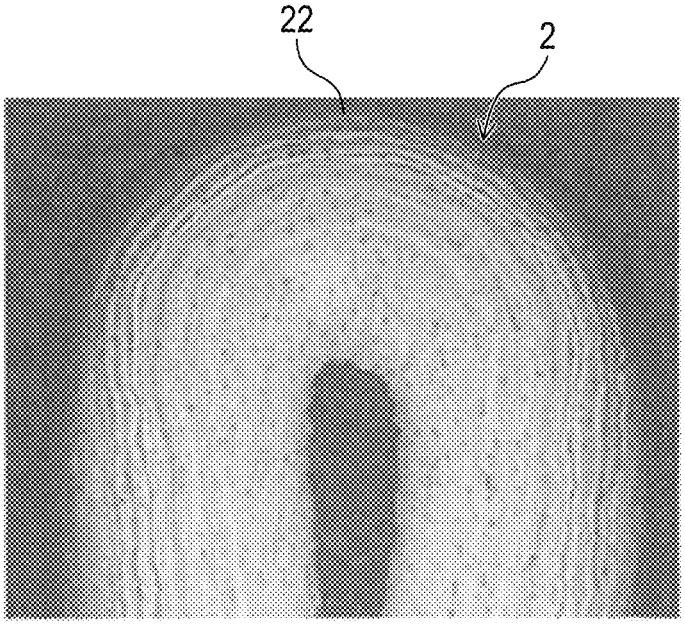
FIG. 6 is a view showing a state of a cross section of the spool formed in the pipe according to a manufacturing method of the present embodiment.

(4a) In the present embodiment, when the third die 6 is pulled out of the pipe 1 in the horizontal direction in the pullout process after forming the spool 2, a state is maintained in which the spool 2 is clamped by the first die 4 and the second die 5. Thus, even if a shear force to pull the pipe 1 in a moving direction of the third die 6 is caused due to friction that may be caused between the third die 6 and the pipe 1, the spool 2 is less likely to be affected by the shear force. In other words, even if a shear force is applied to the pipe 1 in a direction to unfold the spool 2 in the pullout process, movement of the spool 2 is limited by the second die 5 clamping the pipe 1. Accordingly, the manufacturing method of the present embodiment can reduce occurrence of cracks in the spool 2 formed in the pipe 1, and thus cracks are less likely to occur in an inside portion of the top region 22 of the spool 2, for example, as shown in a cross section after forming the spool 2 in FIG. 6.

Figure 7:
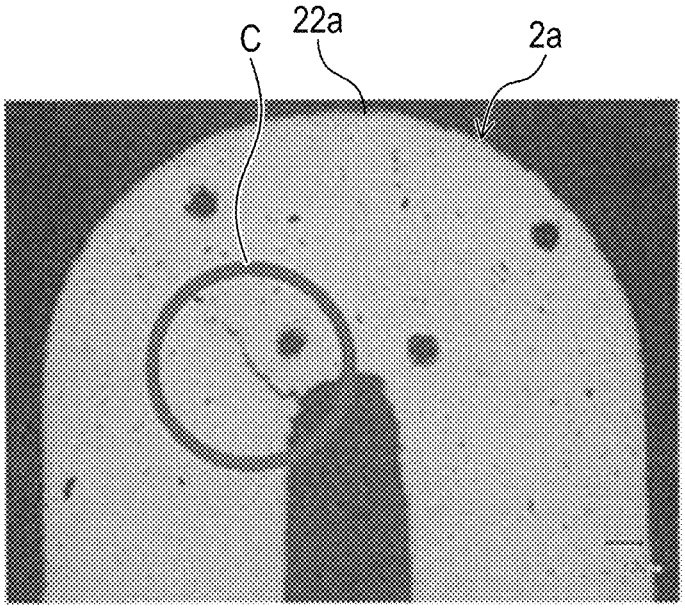
FIG. 7 is a view showing a state of a cross section of a spool formed in a pipe according to a manufacturing method of a comparative example.

On the other hand, according to a manufacturing method of a comparative example, in which a spool 2*a* is formed between the first die 4 and the third die 6, for example, using a configuration without the second die 5, unlike the manufacturing apparatus 3 of the present embodiment, the spool 2*a* is not clamped by the dies when the third die 6 is pulled out of the pipe 1 in the horizontal direction. Thus, if a shear force to pull the pipe 1 in the moving direction of the third die 6 is caused due to friction that may be caused between the third die 6 and the pipe 1, then the spool 2*a* is more likely to be affected by the shear force. Specifically, if shear force to pull the pipe 1 in the moving direction of the third die 6 is caused, then a force is applied to unfold the spool 2*a*. Accordingly, in the manufacturing method of the comparative example, cracks are more likely to occur in the spool 2*a* formed in the pipe 1. Thus, for example, as shown in a cross section after forming the spool 2*a* in FIG. 7, a crack C is more likely to occur in an inside portion of the top region 22*a* of the spool 2*a*.

(4b) In the present embodiment, there is a clearance between the insertion portion 62 of the third die 6 inserted into the pipe 1 and the side wall 12 of the pipe 1 when forming the spool 2. Thus, when the third die 6 is pulled out of the pipe 1, friction that may be caused between the third die 6 and the pipe 1 is more likely to be small as compared with a configuration with no clearance between the insertion portion 62 of the third die 6 inserted into the pipe 1 and the side wall 12 of the pipe 1. Accordingly, cracks can be less likely to occur in the spool 2 formed in the pipe 1.

(4c) In the present embodiment, the first die 4 and the second die 5 are integrally configured through the repulsive force generation device 7. Accordingly, it is possible to avoid excessive size increase of the manufacturing apparatus 3 for forming the pipe 1 provided with the spool 2, and to facilitate storage and maintenance of the manufacturing apparatus 3.

(4d) In the present embodiment, an elastic member, such as a spring, is used as the repulsive force generation device 7. Accordingly, it is possible to easily increase or reduce the specific distance between the first die 4 and the second die 5, which are integrally formed at the specific distance apart from each other, by means of an elastic force of the elastic member.

(4e) In the present embodiment, the preliminary spool 20 as a preliminary configuration of the spool 2 is formed in the pre-forming process. Accordingly, it is possible to stabilize the shape and height of the spool 2 formed in the forming process. Also, formation of the preliminary spool 20 can reduce loads applied to the respective dies when forming the spool 2 in the forming process. Further, formation of the preliminary spool 20 can reduce a springback amount after forming the spool 2. Moreover, since formation of the preliminary spool 20 is performed by pipe expansion processing and pipe contraction processing, reduction in plate thickness when forming the spool 2 can be decreased, compared with a case of forming the preliminary spool 20, for example, by roll-forming or press-forming.

(4f) In the present embodiment, in a state where the pipe 1 is arranged to extend in the horizontal direction, the pipe 1 is clamped from above and below by the first upper die 4*a* and the first lower die 4*b* of the first die 4, and the second upper die 5*a* and the second lower die 5*b* of the second die 5, and then the third die 6 is moved in the horizontal direction, to thereby form the spool 2. Thus, in a case of forming the spool 2 in the pipe 1 of long length, the pipe 1 is less likely to fall over without clamping a large area of the pipe 1 by the first die 4 and the second die 5, as compared with a case where the pipe 1 is arranged to extend in a vertical direction and the third die 6 is moved in the vertical direction. Accordingly, it is possible to limit size increase of the manufacturing apparatus 3 when forming the spool 2 in the pipe 1 of long length.

It is to be noted that the pullout process corresponds to one example of a separating process.

5. Other Embodiments

Although one embodiment of the present disclosure has been described above, it is to be understood that the present disclosure is not limited to the above-described embodiment, but may be implemented in various forms.

(5a) The above-described embodiment exemplifies a configuration in which the first die 4 and the second die 5 are coupled through the repulsive force generation device 7. However, for example, the first die 4 and the second die 5 may be not coupled to each other.

(5b) The above-described embodiment exemplifies a configuration in which the cutout 43 provided to the first die 4 forms the groove 45 in order to form the spool 2 between the first die 4 and the second die 5. However, for example, a cutout may be provided to the second die in order to form a groove between the first die and the second die. Alternatively, for example, a spool may be formed between the first die and the second die in a configuration in which no cutout is provided to any of the first die and the second die. Specifically, a configuration may be employed in which a spool is formed by a second die-side end surface of the first die and a first die-side end surface of the second die each abutting the spool.

(5c) Although the above-described embodiment exemplifies a configuration in which an elastic member, such as a spring, is employed as the repulsive force generation device 7, the repulsive force generation device is not limited to this configuration. For example, a mechanism of separating the second die 5 from the first die 4 by the repulsive force generation device may be achieved by employing a cylinder, a magnet, or other component.

(5d) The insertion portion 62 and the second pressing portion 64 of the third die 6 may be not integrated but separate from each other. Also, the third die may be configured to clamp the pipe 1 only from outside, unlike the third die 6 of the above-described embodiment configured to clamp the pipe 1 from both inside and outside. In other words, the third die may be configured not to include a configuration to be inserted into the pipe 1, such as the insertion portion.

(5e) The above-described embodiment exemplifies a configuration in which the manufacturing processes for forming the pipe 1 provided with the spool 2 include the pre-forming process. However, for example, the manufacturing processes for forming the pipe 1 provided with the spool 2 need not include the pre-forming process.

(5f) A function performed by a single element in the aforementioned embodiments may be achieved by a plurality of elements, or a function performed by a plurality of elements may be achieved by a single element. Also, a part of a configuration in the aforementioned embodiments may be omitted. Moreover, at least a part of a configuration in the aforementioned embodiments may be added to, or may replace, another configuration in the aforementioned embodiments. Any form included in the technical idea defined only by the language of the claims may be an embodiment of the present disclosure.

What is claimed is:

1. A method for forming a spool, which is a portion protruding outward of a pipe, in a part of a side wall of the pipe, the method comprising:

clamping the pipe by clamping the side wall of the pipe by a first die comprising at least two members and also clamping the side wall of the pipe by a second die comprising at least two members;

forming the spool between the first die and the second die by making the first die and the second die approach each other, while pressing an end of the pipe by a third die toward the first die along a longitudinal direction of the pipe;

separating the third die from the pipe along the longitudinal direction of the pipe such that the second die and the third die separate from each other in a state where the spool is clamped by the first die and the second die; and unclamping the pipe by releasing clamping of the pipe such that at least one of the at least two members of the first die and at least one of the at least two members of the second die separate from the side wall of the pipe, forming a preliminary spool before forming the spool, the preliminary spool being a preliminary configuration of the spool, the forming of the preliminary spool including:

a pipe expansion process to expand the pipe; and a pipe contraction process to contract the pipe after the pipe expansion process, and the spool being formed based on the preliminary spool.

2. The method according to claim 1, wherein the first die and the second die are coupled through a repulsive force generation device, wherein the second die is pressed in directions to clamp the pipe when forming the spool and separating the third die from the pipe, and wherein, at the time of unclamping of the pipe, when the second die becomes no longer pressed in the directions to clamp the pipe, the first die and the second die separate from each other by the repulsive force generation device.

3. The method according to claim 2, wherein the repulsive force generation device is an elastic member.

4. The method according to claim 1, wherein the longitudinal direction is a direction along a horizontal direction, wherein the first die comprises:

a first upper die configured to surround the pipe from above; and a first lower die configured to surround the pipe from below, wherein the second die comprises:

a second upper die configured to surround the pipe from above; and a second lower die configured to surround the pipe from below, and wherein the third die is configured to move in the direction along the horizontal direction.

* * * * *